US006902696B2

(12) United States Patent
Klingensmith et al.

(10) Patent No.: US 6,902,696 B2
(45) Date of Patent: Jun. 7, 2005

(54) OVERFLOW TRANSFER FURNACE AND CONTROL SYSTEM FOR REDUCED OXIDE PRODUCTION IN A CASTING FURNACE

(75) Inventors: Marshall A. Klingensmith, New Kensington, PA (US); Michael J. Kinosz, Apollo, PA (US); Rick A. Borns, Spring Lake, MI (US)

(73) Assignee: Alcoa Inc., Pittsburgh, PA (US)

( * ) Notice: Subject to any disclaimer, the term of this patent is extended or adjusted under 35 U.S.C. 154(b) by 81 days.

(21) Appl. No.: 10/133,811

(22) Filed: Apr. 25, 2002

(65) Prior Publication Data

US 2003/0201583 A1 Oct. 30, 2003

(51) Int. Cl.[7] ..... C21D 11/00
(52) U.S. Cl. ..... 266/94; 266/239; 222/595
(58) Field of Search ..... 266/94, 236, 239; 222/590, 591, 595

(56) References Cited

U.S. PATENT DOCUMENTS

| | | | | |
|---|---|---|---|---|
| 2,204,173 A | | 6/1940 | Browser, Jr. | |
| 4,060,408 A | | 11/1977 | Kuhn | 75/68 R |
| 5,178,818 A | | 1/1993 | Ikoma et al. | 266/196 |
| 5,203,681 A | | 4/1993 | Cooper | 417/424.1 |
| 5,269,362 A | | 12/1993 | Yamishita | 164/155 |
| 5,330,328 A | | 7/1994 | Cooper | 417/424.1 |
| 5,350,440 A | | 9/1994 | Katyal et al. | 75/686 |
| 5,388,633 A | | 2/1995 | Mercer, II et al. | 164/457 |
| 5,398,750 A | * | 3/1995 | Crepeau et al. | 164/154 |
| 5,403,381 A | | 4/1995 | Areaux | 75/708 |
| 5,407,000 A | | 4/1995 | Mercer, II et al. | 164/457 |
| 5,542,651 A | | 8/1996 | Kanazumi et al. | 266/231 |
| 5,593,634 A | | 1/1997 | Waite et al. | 266/217 |
| 5,620,043 A | | 4/1997 | Chamarro et al. | 164/119 |
| 5,725,043 A | | 3/1998 | Schaefer et al. | 164/119 |
| 5,762,680 A | | 6/1998 | Holta et al. | 75/600 |
| 5,812,587 A | | 9/1998 | Locatelli | 373/79 |
| 5,908,488 A | * | 6/1999 | Schroder et al. | 75/386 |
| 5,913,353 A | | 6/1999 | Riley et al. | 164/113 |
| 5,917,115 A | | 6/1999 | Wondris | 75/508 |
| 5,996,677 A | | 12/1999 | Woodhouse | 164/136 |
| 6,019,576 A | | 2/2000 | Thut | 415/200 |
| 6,093,000 A | | 7/2000 | Cooper | 417/423.6 |
| 6,503,292 B2 | * | 1/2003 | Klingensmith et al. | 266/94 |

* cited by examiner

*Primary Examiner*—Scott Kastler
(74) *Attorney, Agent, or Firm*—Grant E. Coffield; Eckert Seamans Cherin & Mellott, LLC

(57) ABSTRACT

An apparatus for transferring molten metal from a melting furnace to a casting furnace is provided. A sensing and control system for the transfer of molten metal from a transfer furnace to a casting furnace is also described. The combination of the transfer apparatus with the sensing and control system provides for the introduction of reduced oxide molten metal into a casting furnace.

16 Claims, 7 Drawing Sheets

OVERFLOW TRANSFER FURNACE AND CONTROL SYSTEM FOR REDUCED OXIDE PRODUCTION IN A CASTING FURNACE

FIELD OF THE INVENTION

The present invention relates to transfer furnaces, systems and methods for providing molten metal to a casting furnace. The devices and methods of the present invention enable the transfer of molten metal from a launder to a casting furnace such that there is a reduction in the production of metal oxides or dross and a reduction of wasted molten metal.

BACKGROUND OF THE INVENTION

Delivery of molten metal, such as aluminum or aluminum alloys (collectively referred to herein as aluminum), to a casting furnace is a multi-step process. Initially, aluminum ingots may be melted in a melting furnace and the molten aluminum may then be dispensed from the melting furnace to a launder. In such an arrangement, the molten aluminum flows from the launder to a holding furnace (transfer furnace) where its temperature is preferably maintained prior to being introduced into a casting furnace.

While the molten aluminum is present in the transfer furnace, it may be degassed and filtered to remove absorbed oxygen and inclusions (e.g., metal oxides, dross) prior to being transferred to the casting furnace. A common method of transferring molten metal from a transfer furnace to a casting furnace is via a discharge trough that leads from the transfer (or holding) furnace to the casting furnace. According to this method, the molten metal flows by gravity from the trough into the casting furnace.

Generally, a casting furnace is located beneath a casting machine. Several mechanisms are currently employed to facilitate the transfer of molten metal from the discharge end of a holding furnace to a metal bath of a casting furnace. One common arrangement is a stopper rod box system. In this system, a stopper rod box is attached to the end of the transfer furnace discharge trough. The stopper rod box controls the flow of molten aluminum from the transfer furnace with a removable stopper rod. To transfer metal from the transfer furnace to the casting furnace, the stopper rod is removed from a hole in the bottom of the stopper rod box, allowing the gravitational flow of metal through the bottom of the box into an open air trough that connects to an open hole in the bottom platen of the casting machine. When the stopper rod is removed the metal falls to the surface of the metal bath in the casting furnace. To terminate flow, the stopper rod is inserted back into the hole in the stopper rod box. The hole in the platen is then shut with a flat plate and gasket to permit subsequent pressurization of the casting furnace—to move the metal up into the casting machine.

While the stopper rod box is a simple system with few moving parts, a significant amount of maintenance is required to prevent leakage of molten metal at the stopper rod. The components of the stopper box are located underneath molten aluminum, which makes them inaccessible during operations and difficult to maintain without shutting down the process. Poor maintenance can result in metal leaks at the discharge point and result in costly and time-consuming cleanup.

Alternatively, various pump configurations have been used to transfer molten aluminum from the transfer furnace to the trough that leads to the casting furnace. For example, Lindberg and Holimsey pumps are commonly employed and are well-known in the art.

In the case of a Lindberg pump transfer system, the pump is mounted in the discharge end of the transfer furnace. To transfer metal to the casting furnace, air pressure is applied to the top surface of the molten metal in the pump. The metal flows out of a channel running from the bottom of the pump to a discharge point above the pump housing and into an open air trough. From the trough, the metal follows a similar path to the casting furnace, namely cascading out of the trough into a hole in the platen and falling to the surface of the metal bath in the casting furnace.

In both the Lindberg and Holimsey pump transfer systems, metal is transferred from the transfer furnace to the casting furnace through the enclosed structure of the pump. While neither pump has any moving parts, the enclosed nature of these pumps makes periodic cleaning very time consuming. The transfer operations must be shut down to allow for disassembly of the pump for cleaning. Further, both pumps rely on a good quality seal during re-assembly to get a repeatable volume of metal transfer. In addition, the cascading of molten metal from either the stopper box or pump transfer systems, promotes the formation of oxides in the molten metal immediately prior to its introduction into the casting furnace.

When transferring molten aluminum from a transfer furnace to the casting furnace by means of either the stopper rod box assembly or a pump as described above, the volume of metal that is transferred is dependent on the level of metal in the transfer furnace. If the level of molten aluminum in the launder drops too dramatically, the amount of metal in the transfer furnace will be insufficient to provide an adequate volume of molten metal to the casting furnace.

It is desirable, therefore, to provide molten metal to the casting furnace on demand and substantially independent of the level (volume) of metal in the launder or transfer furnace so that casting may proceed in an efficient manner. Transfer via either a stopper rod box or current pumping technology exposes the molten metal to atmospheric oxygen unnecessarily. This exposure can contribute to the formation of oxides and inclusions within the molten metal supplied to the casting furnace. It would be desirable, therefore, to provide an apparatus and system that transferred an aliquot of molten metal to a casting furnace in a manner that substantially avoided contact with the atmosphere to thereby reduce the percentage of oxides and inclusions that are formed.

In addition, the temperature of the metal that is discharged from the transfer furnace can vary and may further contribute to undesirable properties of the finished cast metal. It would be desirable, therefore, to develop a system and apparatus for delivering molten metal to a casting furnace on demand in which the metal displays a substantially uniform temperature to help maintain or enhance the desirable properties of the finished cast metal.

SUMMARY OF THE INVENTION

The present invention allows for the introduction of molten metal, for example, aluminum, of a uniform temperature to a casting furnace with a reduced production of oxides. The transfer apparatus has a reduced number of movable parts that are subject to submersion in the molten metal or aluminum. The present invention also allows for the automated delivery of molten metal or aluminum on demand into a casting furnace by means of a controlled overflow of a transfer furnace. The present invention further allows the transfer of metal to a casting furnace largely independently of the overall level of molten metal in the launder.

The method of transfer includes a transfer furnace with a metal level control system and a recirculating pump. The metal is transferred below the surface of the metal flow in the transfer trough and discharged below the surface of the metal bath in the transfer furnace.

These and other features and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

BRIEF DESCRIPTION OF THE DRAWINGS

The present invention and its presently preferred embodiments will be better understood by reference to the detailed disclosure herein and to the accompanying drawings, wherein.

DETAILED DESCRIPTION OF PREFERRED EMBODIMENTS

Figure 1:
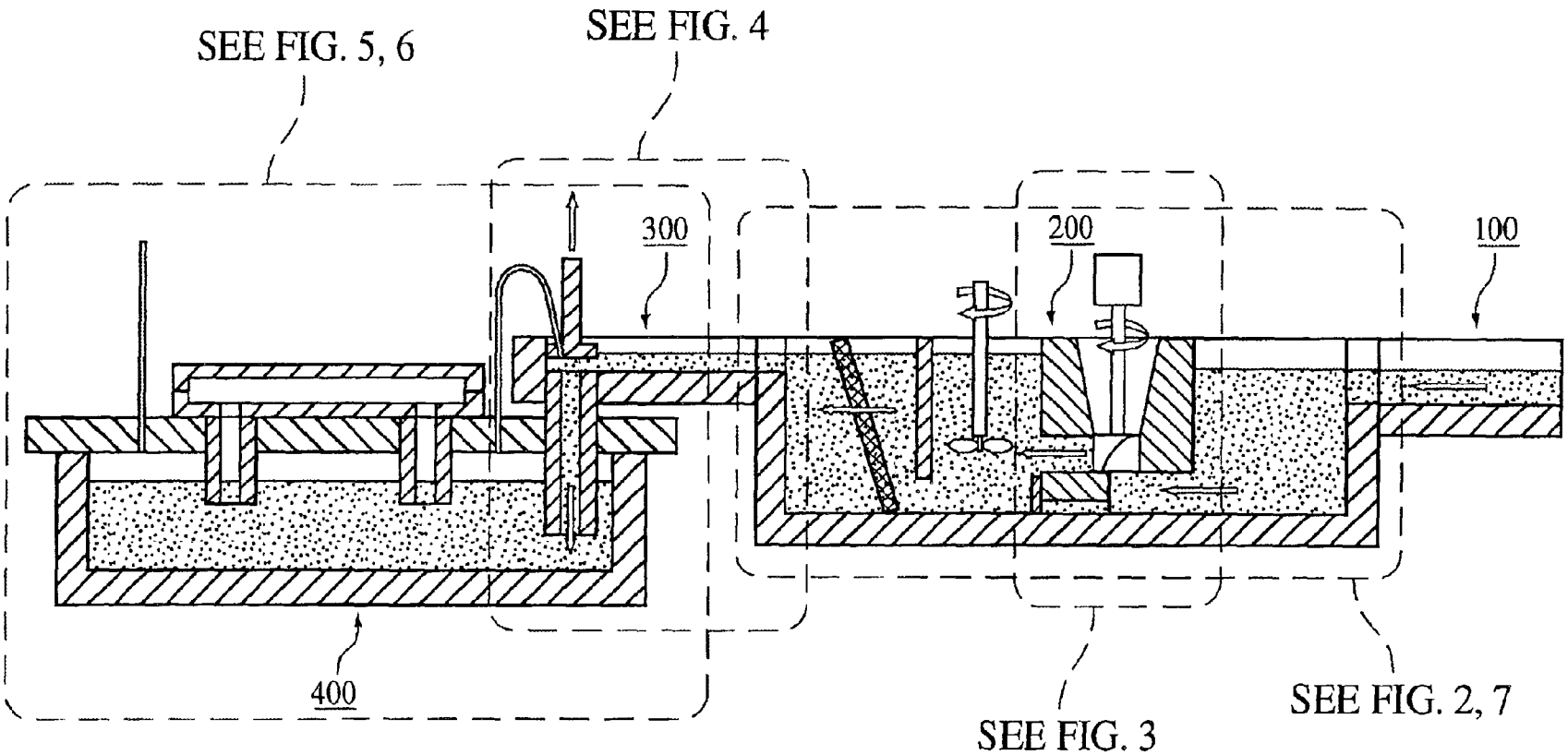
FIG. 1 is a schematic cross section of a metal furnace and casting system showing a preferred arrangement of a launder, a transfer furnace, a transfer trough and a casting furnace.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, like numbers refer to like elements throughout. It will be understood that when a feature, such as a surface layer, region or component is described as being "on" another element, it can be directly on the other element or intervening elements may also be present. Further, terms such as "upstream," "downstream" or like terms as used herein, refer to the relative positions of components based upon the flow of molten metal.

The term "adjacent" is used throughout in the broadest sense such that, for example, a sensor that is located "adjacent" to a casting furnace can be located within the interior of the furnace, on the exterior of the furnace, or even remote from the furnace. The only limitation on the physical location of a sensor located "adjacent" a casting furnace is that the sensor be in such a proximity to facilitate sensing of the condition of the casting furnace being monitored (e.g., the level of molten metal).

Figure 7:
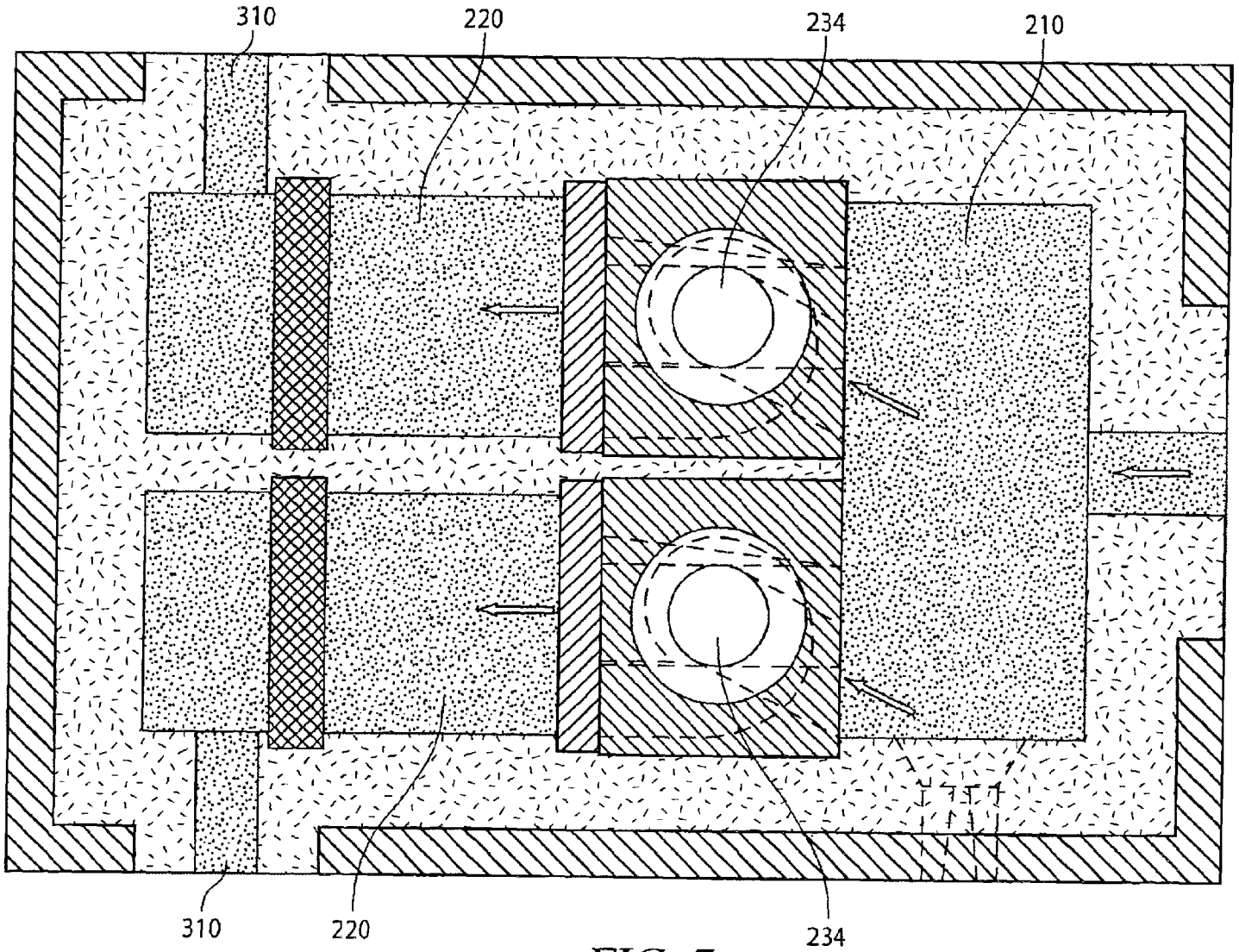
FIG. 7 is a top view of a transfer furnace showing an embodiment with a plurality of downstream chambers that are capable of supplying multiple casting furnaces, in accordance with a preferred embodiment of the present invention.

In the manufacturer of cast aluminum products, molten aluminum is transferred from a melting furnace (or other such source of molten aluminum) to a casting furnace by way of an intervening launder and transfer furnace. In accordance with the present invention, with reference to FIG. 1, a schematic cross section is shown of a launder 100, a transfer furnace 200, a transfer trough and downspout arrangement 300 and a casting furnace 400. The molten aluminum flows into the transfer furnace 200 from a launder 100. While it is present in the transfer furnace 200, the molten metal may be heated and treated as known in the art prior to flowing through a transfer trough and downspout arrangement 300 to a casting furnace 400. In some instances, a transfer furnace may be segmented into multiple compartments to supply more than one casting furnace, for example, as described below and as shown in FIG. 7.

Figure 2:
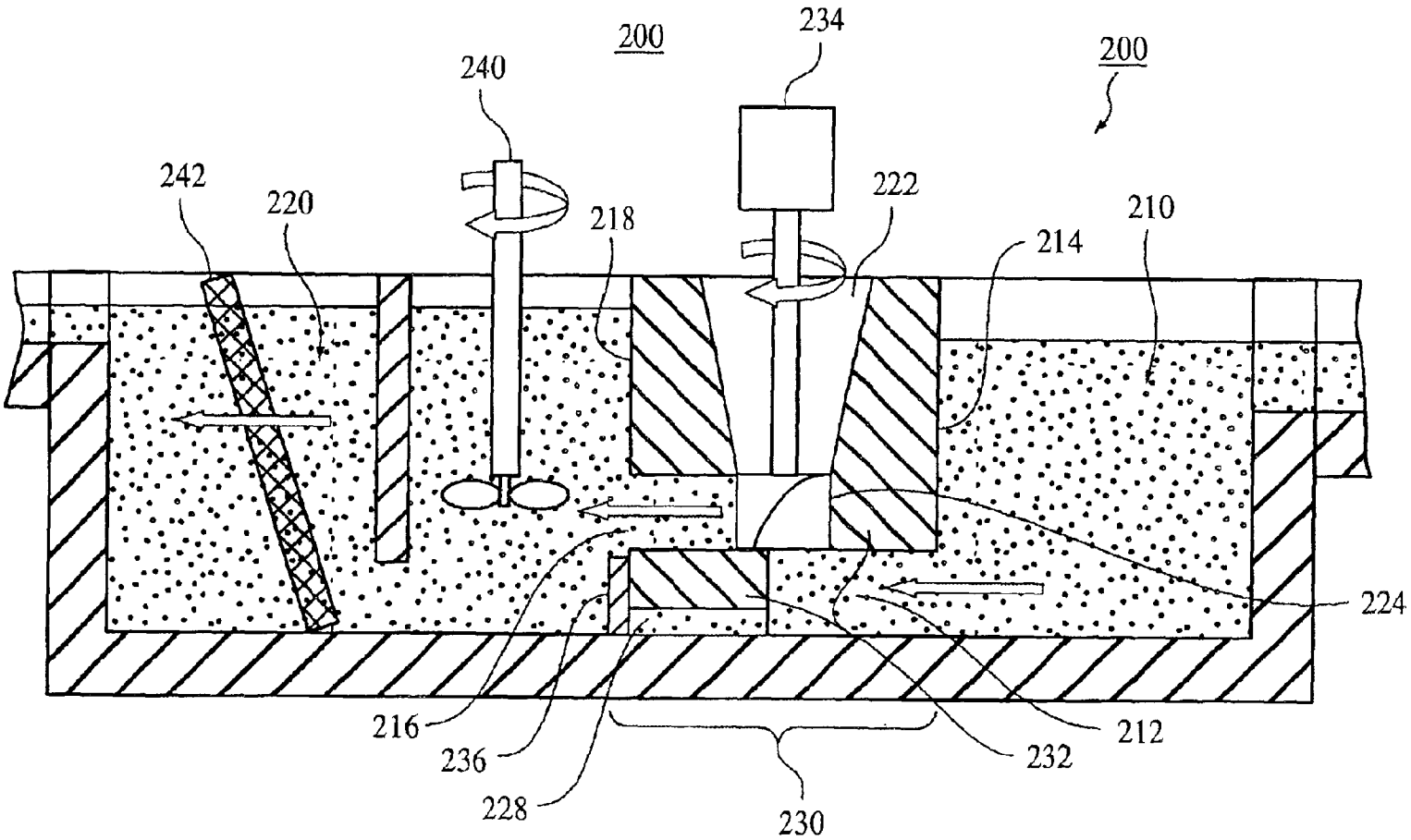
FIG. 2 is a more detailed cross sectional view of a transfer furnace, in accordance with a preferred embodiment of the present invention.

With reference to FIG. 2 the transfer furnace 200 is preferably divided into a plurality of chambers. For example, an upstream chamber 210 and a downstream chamber 220 can be formed by dividing the interior space of the transfer furnace 200 with a structure 230 that extends across the interior space of the transfer furnace 200 in a direction perpendicular to the flow of molten aluminum. In a preferred embodiment, the structure 230 is a wall 232 that houses a pump 234. The pump 234 is capable of transferring molten metal from the upstream chamber 210 to the downstream chamber 220 for example, through openings 212, 216 in the structure 230.

FIG. 2 shows one embodiment of the structure 230 as a wall 232 bisecting the upstream chamber 210 and the downstream chamber 220—near the mid-point of the transfer furnace 200. The structure 230 may extend across the interior space of the transfer furnace 200 perpendicular to the flow of molten aluminum at any practical point, such that the upstream and downstream chambers need not be of equal size and/or capacity. The structure 230 may have an intake opening 212 at the leading face 214 of the wall 232, such that molten metal can enter (e.g., be pulled into as a result of the action of pump 234) on its passage through a channel created by intake opening 212 and exit through an opening 216 at the downstream face 218 of the wall 232.

Figure 3:
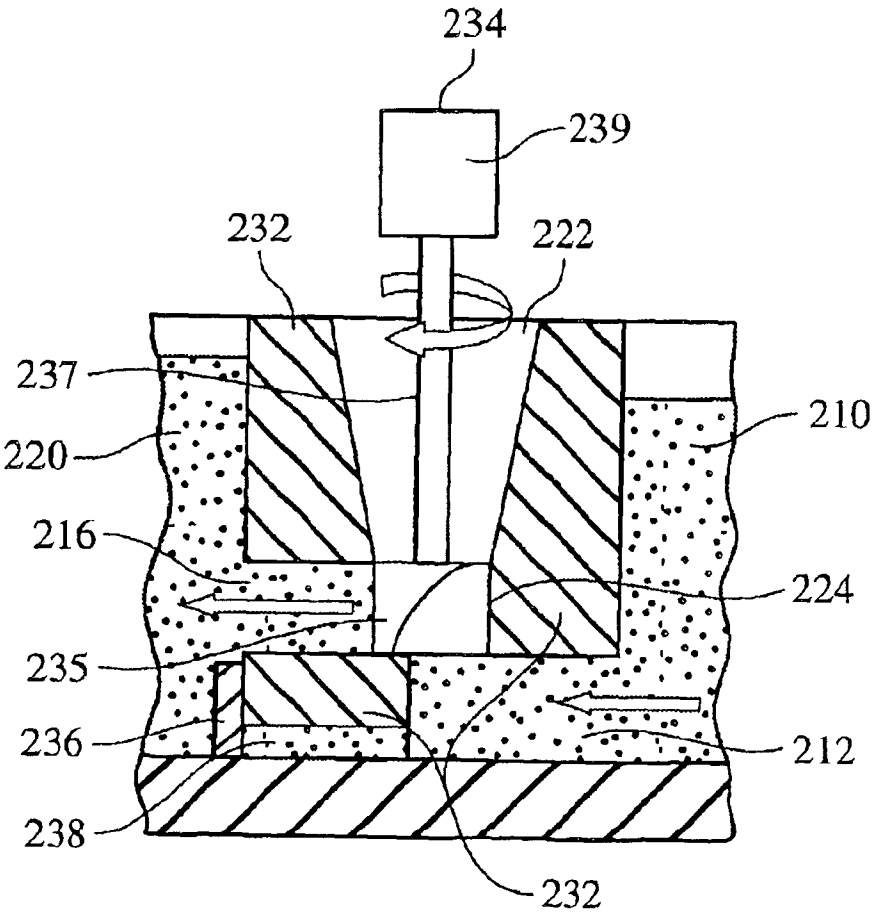
FIG. 3 is a more detailed cross sectional view of a wall within the transfer furnace, in accordance with a preferred embodiment of the present invention.

As shown in more detail in FIG. 3, the wall 232 is shown with a central cavity 222 into which a pump 234 fits. It will be appreciated that any number of pumps that are capable of pumping molten metal may be used in this arrangement. For example, Metaullics Systems Co., L.P. (metaullics.com) manufactures several types of pumps that will work with this concept.

In accordance with the preferred embodiments of the present invention, the pump 234 must be capable of changing its speed (e.g., from off to on, or from low rpm to a higher rpm) in response to, for example, the prompts or signals of the downstream sensors, as discussed in greater detail below.

The fit between the pump casing 235 and the lower portion of the pump cavity 224 is preferably such that no molten aluminum may leak between the casing 235 of the pump 234 and the internal portions of the cavity 224 adjacent to the pump casing 235. It is most preferable that the active flow of molten aluminum from the upstream chamber 210 to the downstream chamber 220 is through the pump ports (not shown).

While numerous types of pump will work with the present invention, the pump 234 is preferably a variable-speed, centrifugal pump that can draw molten metal from the upstream chamber 210 through the passage 212, in the wall 232 and pump the metal out of opening 216 to the downstream chamber 220. Centrifugal pumps generally include a casing having a pump chamber and an impeller in the chamber. As is well known in the art, the pump can be designed to be a single suction pump (in which case the material to be pumped enters through a single inlet generally in parallel with the pump shaft) or it can be a double suction pump in which two inlets are provided generally both in line with the pump shaft.

Generally, for molten aluminum pumps, the pump casing and the impeller are made of graphite. Typically, the pump casing 235 is connected to a superstructure 237. A motor 239 is typically mounted on top of the superstructure 237. Accordingly, the pump 234 may be used to control and affect the volume of metal (e.g., the level of molten aluminum) in the upstream 210 and downstream chambers 220 as described in greater detail below.

With reference to FIG. 2 and FIG. 3 showing a preferred embodiment, the wall 232 may also contain a recirculation conduit 228 that forms a passage between the upstream 210 and downstream 220 chambers such that molten aluminum can passively flow (e.g. recirculate) between the downstream chamber 220 to the upstream chamber 210. Preferably, the recirculation conduit 228 is located along the bottom most section of the wall 232. The recirculation conduit 228 preferably allows the free flow of molten aluminum between the two chambers 210, 220. The rate of flow through the recirculation conduit 228 may be adjusted by a baffle plate 236 that is able to occlude, for example, the downstream opening of the recirculation conduit 228. The size and location of the conduit 228 and the design of the baffle plate 236 are preferably constructed such that the pump 234 can actively move more metal (within the pump's normal operating speeds) than can passively recirculate through the conduit 228. In this way the pump can control the level of metal in the chambers (210, 220).

With reference to FIG. 2, the downstream chamber 220 will preferably contain a degassing device 240 and a filter 242 that are able to remove absorbed gas and inclusions from the molten aluminum.

Figure 4:
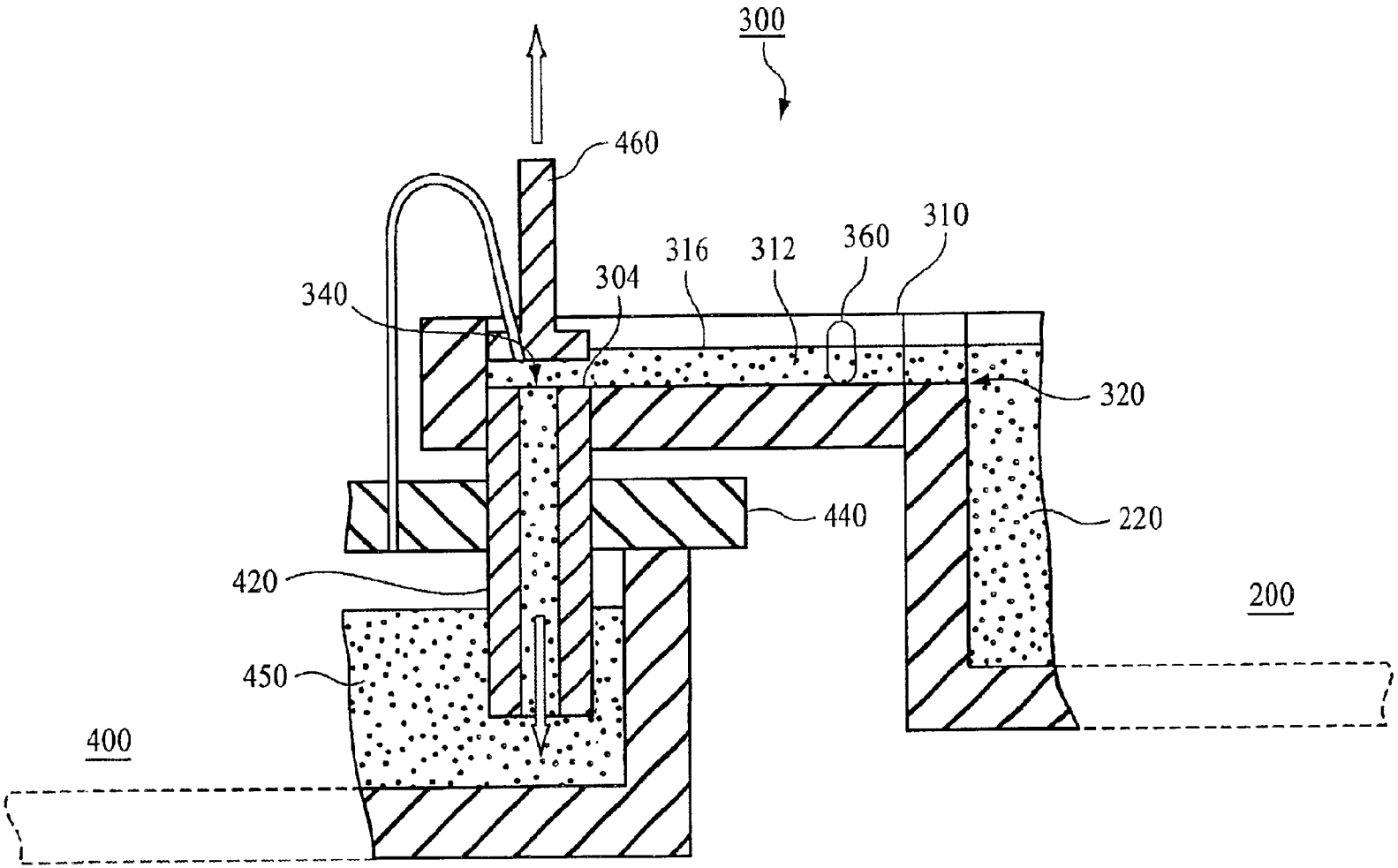
FIG. 4 is a more detailed cross sectional view of a transfer trough and a downspout connection between the transfer furnace and the casting furnace, in accordance with a preferred embodiment of the present invention.

The downstream chamber 220 of the transfer furnace 200 preferably discharges to a trough and downspout arrangement 300. The trough and downspout arrangement 300, as shown in FIG. 4, preferably accepts molten metal that overflows from the downstream chamber 220. The trough and downspout arrangement 300 is arranged to conduct the overflow of molten metal to a point that discharges the flow into a casting furnace 400.

With reference to the embodiments described herein, the phrase "an overflow of molten metal", is meant to describe a condition of altering the level of molten metal in the transfer furnace to a point that the molten metal overflows its confines. This can be accomplished in any variety of ways, including, for example, by contributing an additional quantity of matter to a chamber of fixed capacity (e.g. by pumping in more metal) or, by decreasing the capacity of the chamber so that a quantity of metal held within the decreased space overflows its confines.

As shown in FIG. 4 the overflow trough 310 is preferably oriented in a substantially level arrangement between the point of overflow 320 from the casting furnace 200 (e.g. the downstream chamber) and the discharge 340 to the downspout 420. A level sensor 360 is preferably located adjacent the trough 310 to sense the presence of molten metal in the trough and above the point of overflow 320. This sensor 360 is preferably in communication (not shown) with the means used to control the overflow of metal from the transfer furnace 200 into the trough 310.

The discharge 340 from the trough 300 preferably connects to a downspout 420 which conveys the molten metal from the trough 310, through a top platen 440 of the casting furnace 400, and into a molten metal bath 450.

Figure 5:
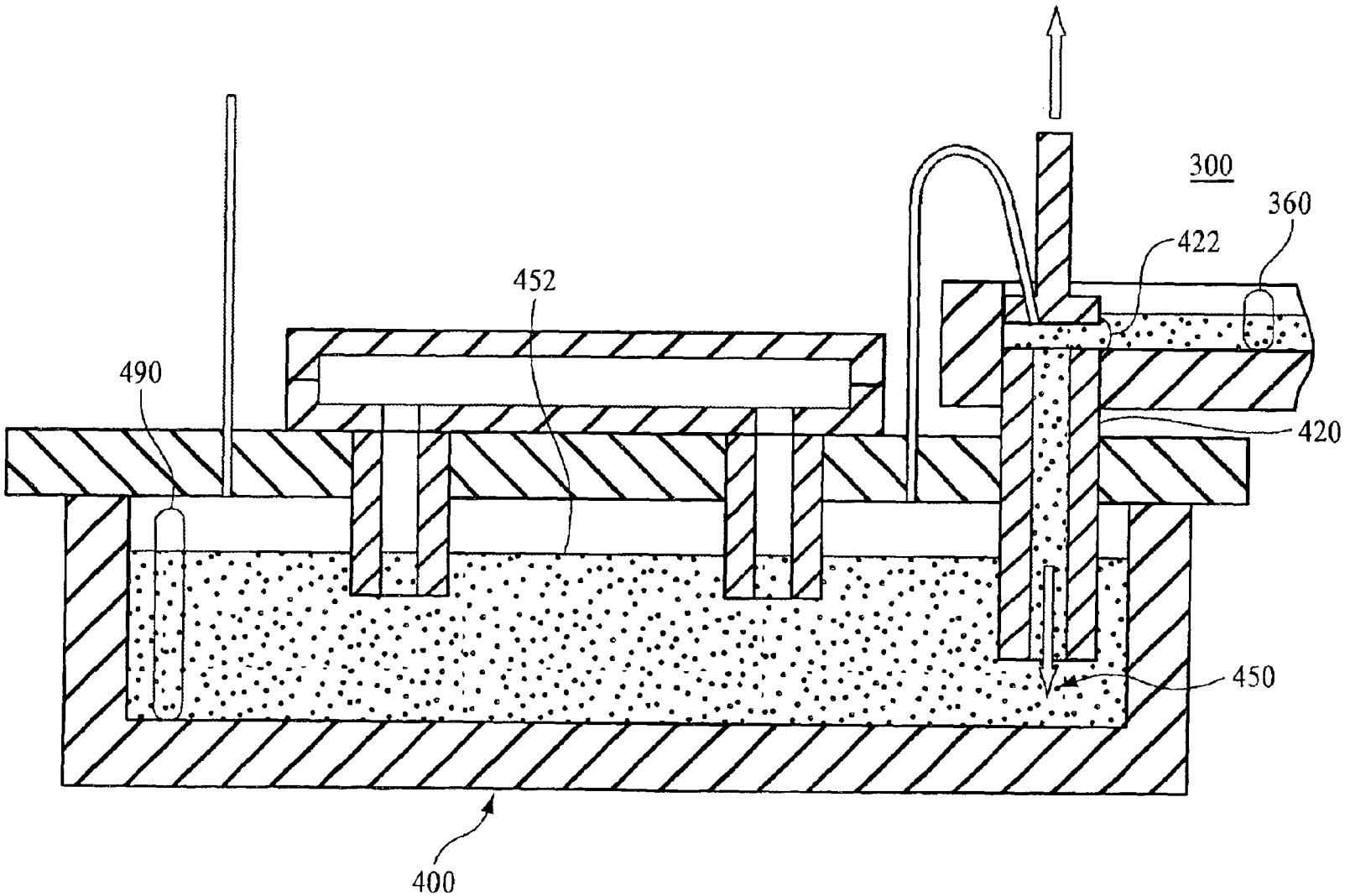
FIG. 5 is a more detailed cross sectional view of a casting furnace shown in the metal transfer phase, in accordance with a preferred embodiment of the present invention.

With reference to FIG. 5, the downspout 420 preferably releases the molten aluminum near the bottom of the casting furnace 400 and below the surface 452 of an already present volume of molten aluminum (i. e., the metal bath 450). This infusion of molten aluminum to a point below the surface 452 in the metal bath 450 avoids a "cascading" action and therefore inhibits the formation of oxides and dross within the casting furnace 400.

Figure 6:
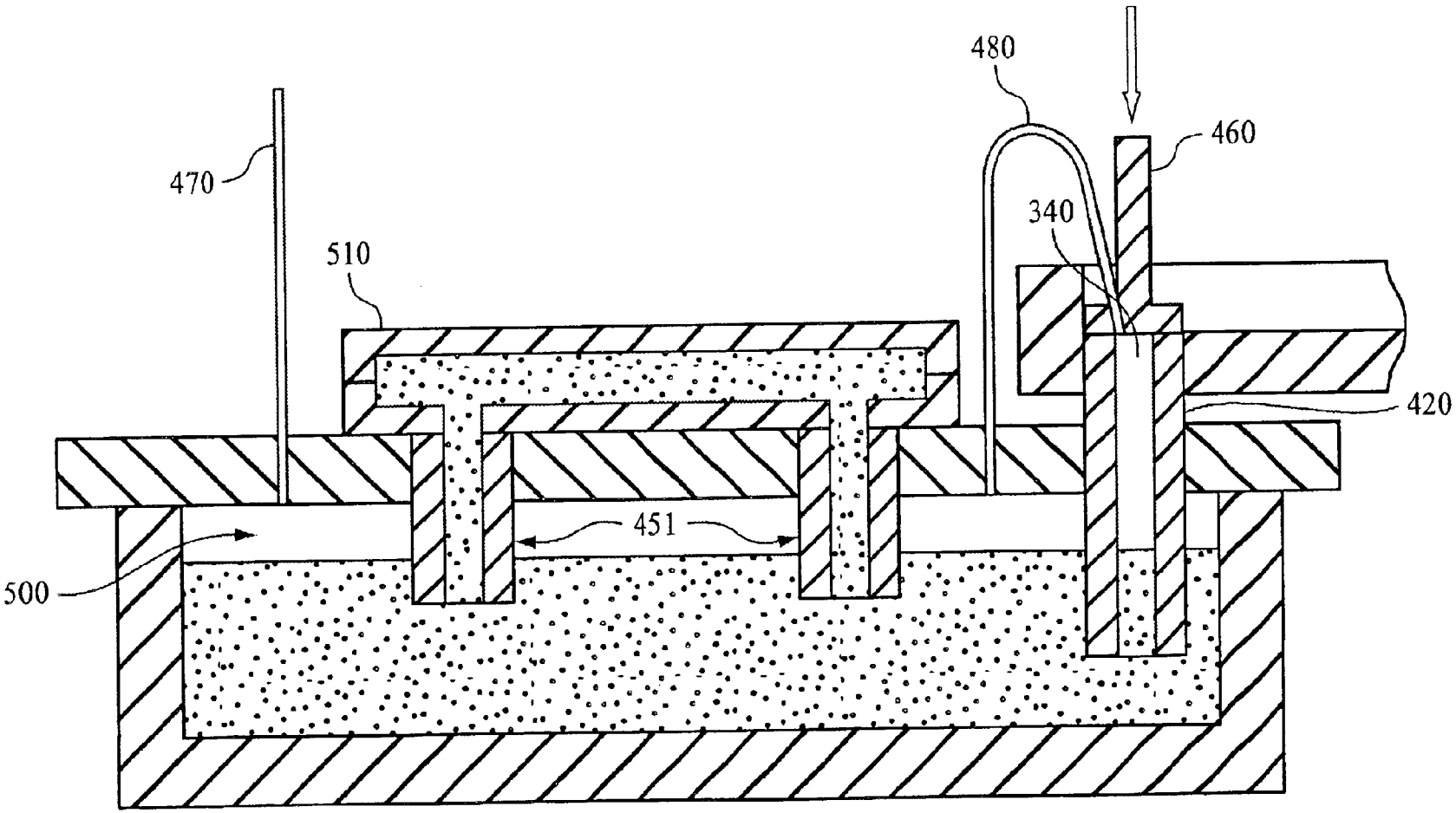
FIG. 6 is a more detailed cross sectional view of a casting furnace shown in the casting phase, in accordance with a preferred embodiment of the present invention.

After a sufficient volume of molten metal has been transferred to the casting furnace 400, the casting process can proceed as shown in FIG. 6. Preferably the overflow of molten metal from the transfer furnace is interrupted (e.g., speed of the pump is reduced), the downspout 420 is sealed by a shut-off device 460 and the internal pressure inside the casting furnace is increased by pumping air or other gas into the furnace via a pressurization line 470, thereby forcing molten aluminum up through fill tubes 451 and into a casting mold 510. Preferably, the casting furnace 400 is equipped with a pressurization equalizer line 480 which functions to balance the pressure within the downspout 420 during the casting process.

Another preferred embodiment of the present invention includes a plurality of sensors that detect and/or monitor the discharge of molten metal from the transfer furnace to the casting furnace. In one arrangement as shown in FIG. 5, the transfer trough 310 that accepts the overflow from the transfer furnace contains a first sensor 360 that is capable of measuring the presence of molten aluminum in the transfer trough 310. The first sensor 360 preferably communicates the presence or absence of metal in the trough 310 in the form of a signal or prompt. The sensor 360 may also measure the volume of molten metal present and/or the depth level of the flow. The information from the sensor preferably generates a signal or prompt that can be used to adjust the overflow from the casting furnace, for example, by effecting the speed of the pump as described below.

A second sensor 490 is preferably located within the casting furnace 400. The second sensor 490 preferably measures the level of molten aluminum in the casting furnace 400 and communicates this information in the form of a signal or prompt. The signal or prompt from this second sensor is preferably used in the control system to regulate the volume of metal in the casting furnace, for example, by adjusting the opening 422 via shut-off valve 460 in the downspout 420, or the speed of the pump as described below.

With reference to FIG. 1 and FIG. 2, the general features of the preferred processes and systems can be described as follows. Molten metal (e.g., molten aluminum) flows from a melting furnace into the transfer furnace 200 from a launder 100. The molten aluminum is preferably transferred from the upstream chamber 210 through the structure 230 (e.g.) to the downstream chamber 220 by increasing the speed of a centripetal pump 234. Once the molten aluminum is in the downstream chamber 220, it may be degassed by a degasser 240, and filtered by a filter 242, for example, as shown in U.S. Pat. No. 4,964,993.

The molten aluminum in the downstream chamber 220 may flow back into the upstream chamber 210 via the recirculation conduit 228. The volume of aluminum allowed to flow through the recirculation conduit 228 may be controlled by adjusting a baffle plate 236. Thus, a balance may be established between molten aluminum being pumped into the downstream chamber 220 (by varying the speed of the pump 234) and recirculation of molten aluminum to the upstream chamber 210, by adjusting the baffle plate to occlude the opening of conduit 228.

When no molten aluminum is being transferred to the casting furnace 400, for example during the casting process, the balance of molten metal between chambers 210, 220 is preferably maintained such that the level of molten aluminum is in relative equilibrium in each chamber 210, 220. Further, the pump 234 will preferably move molten metal into the downstream chamber 220 such that continuous degassing and filtration will take place.

Upon receiving a prompt from a sensor or sensors, e.g. sensor 490 located downstream of the transfer furnace, the transfer cycle of molten aluminum from the transfer furnace 200 to the casting furnace 400, is preferably initiated. The level in the downstream chamber 220 will preferably be raised to allow the molten aluminum to overflow the downstream chamber 220 and to flow down the trough 310 to the downspout 420 that leads to the casting furnace 400. The level of molten aluminum in the downstream chamber 220 is preferably elevated by increasing the speed of the pump 234 to increase the flow of molten aluminum from the upstream chamber 210 to the downstream chamber 220. The pump speed may continue to increase or stay at an elevated speed until the first sensor 360 indicates that aluminum is overflowing the downstream chamber 220 (i.e. being discharged from the transfer furnace 200) such that molten aluminum is in the outlet trough 310). Once the first sensor 360 indicates the presence of molten aluminum in the outlet trough 310, the speed of the pump 234 may be maintained or adjusted so as to control the volume and flow rate of molten aluminum in the downstream chamber 220 at a desired level. Molten aluminum preferably flows through the outlet trough 310 to the downspout 420, which in turn discharges the molten metal into the casting furnace 400. Under these conditions, the volume of molten aluminum in the upstream chamber 210 is decreased (and must be replenished) as the molten metal volume in the downstream chamber 220 is increased.

Another embodiment of the present processes and systems can be described more fully with reference to FIG. 4. FIG. 4 is an expanded view of the discharge trough 310 that connects the overflow of the downstream chamber 220 to the top 304 of the downspout 420. A shut-off device 460 is shown partially submerged in molten aluminum 312. At the interface of the molten aluminum 312 with the atmosphere, a layer of oxide or dross 316 is formed. As molten aluminum 312 travels from the trough 310 to the downspout opening 340, aluminum 312 that is not in contact with the atmosphere (i.e., below the surface 316) preferably travels down from the trough 310 through the downspout opening 340. Thus, the layer of oxide on the surface 316 of the molten aluminum 312 is left in the trough 310 and is not transferred to the casting furnace via the downspout 420.

The above-described transfer process preferably continues until an appropriate volume of molten metal has been added to the casting furnace. One way to determine when the proper volume of molten metal has been transferred is to use a second sensor 490 in the casting furnace 400 as shown in FIG. 5. Preferably, the second sensor 490 indicates when sufficient molten metal is present in the casting furnace 400 for casting to commence. For example, the second sensor 490 (or a series of sensors) may communicate this information in the form of a prompt or signal to a controller system that controls the pump. This system may be something as simple as a series of lights to prompt a human operator to take action, or a computerized system of electronic interfaces and control devices or switches that are activated in response to a prompt. In response to a prompt from a sensor (490 or 360), the speed of the pump is preferably reduced such that the overflow of molten metal ceases. The stopper 460 can then be closed to halt the flow of the molten metal into the downspout opening 340 and seal the top 304 of the downspout 420. Preferably, the speed of the pump continues to be reduced until molten metal can flow back from the trough 310 to return to the downstream chamber—wherein it can continue to be filtered and degassed.

When the first sensor 360 indicates that no molten aluminum is present in the outlet trough 310, the pump speed can be adjusted and maintained to substantially equilibrate the volume of molten metal being recirculated between the upstream chamber 210 and the downstream chamber 220.

The molten aluminum remaining in the transfer furnace 200 preferably continues to be degassed and filtered as it recirculates in the downstream chamber 220. As a result of recirculation, the temperature in the upstream 210 and downstream 220 chambers of the transfer furnace 200 is maintained at a substantially uniform temperature. Additional molten metal can be discharged from the melting furnace through the launder 100 to replenish the volume of molten metal that had been previously transferred to the casting furnace.

When the discharge of metal from the transfer furnace has ceased, casting is able to begin. In order to pressurize the casting furnace, a shut-off device 460 is used to close off the opening 340 in the downspout 420. With reference to FIG. 6, the shut-off device 460 seals the opening 340 of the downspout 420 so that molten aluminum cannot flow up out of the casting furnace upon pressurization of the casting furnace chamber 500. A pressure equalization line 480 also prevents molten aluminum from flowing back up the downspout 420 by equilibrating the pressure in the downspout 420 with that in the chamber 500 of the casting furnace 400. Following the sealing of the downspout 420, the pressure within the casting furnace is increased by pumping air or other gas into the furnace chamber 500 via a pressurization line 470. Molten aluminum then flows up into the casting machine 510, for example, via infusion tubes 451.

FIG. 7 shows a further embodiment of a top view of a transfer furnace arranged in accordance with the present invention. The top view shows a parallel pump and dual downstream chamber design. In this embodiment, a common upstream chamber 210 serves as a supply reservoir for two (2) pumps 234, each of which is capable of pumping metal to a single, separate, downstream chamber 220. Each chamber has its own overflow trough 310 which can supply molten metal to a separate casting furnace (not shown), as described above. The use of a common upstream chamber 210 with a plurality of downstream chambers 220 allows for a more continuous flow of molten metal through the transfer furnace. Additionally, when demand for molten metal ceases in one casting furnace, the subsequent reduction in pumping action by one pump 234 will have less relative impact on the overall steady state characteristics of the transfer furnace. For example, the level of molten metal should be less impacted, as well as the temperature variation of the metal bath.

Several advantages are realized by the present invention. First, the need for high maintenance stopper box assemblies and Lindberg or Holimesy pumps is eliminated. As distinguished from the prior art, the present invention allows the molten metal level to remain below all transfer openings in the system when the transfer between furnaces of molten metal is not occurring. Furthermore, the present invention reduces the production of oxides and dross that accompanies the use of Lindberg or Holimesy pumps. Avoiding a "cascade effect" by discharging aluminum below the surface of the metal bath in the casting furnace also reduces the generation of oxides and dross in the casting furnace. Further, molten metal infused into the casting furnace is at a substantially uniform temperature due to the continuous recirculation and mixing of molten metal in the transfer furnace. In addition, because of the relative isolation of the upstream chamber from the downstream chamber, the transfer of molten metal to the casting furnace is not impacted by moment-to-moment fluctuations of molten metal supply from the launder.

Nothing in the above description is meant to limit the present invention to any specific materials, geometry, or orientation of parts. While the presently preferred embodiments of the invention are described in terms of aluminum, the practice of this invention is not limited to molten aluminum or aluminum alloys. Many part/orientation substitutions are contemplated within the scope of the present invention. The embodiments described herein are presented by way of example only and should not be used to limit the scope of the invention.

Having described the presently preferred embodiments, it is to be understood that the invention may be otherwise embodied within the scope of the appended claims.

What is claimed is:

1. An apparatus for supplying molten metal to a casting furnace, the apparatus comprising:

(a) a plurality of chambers;

(b) at least one connection between the chambers that allows for the transfer of molten metal between the chambers and is structured to provide a higher melt level in one of said chambers than in another of said chambers; and (c) an outlet from one of the plurality of chambers, said outlet being connected to a casting furnace, arranged to accept an over-flow of molten metal from the chamber such that said over-flow of molten metal can be discharged into the casting furnace, and comprised of a trough and a downspout.

2. The apparatus of claim 1, wherein said at least one connection between the chambers is structured to transfer molten aluminum.

3. The apparatus of claim 1, wherein the over-flow of molten metal that is discharged into the casting furnace is transferred substantially without contacting the atmosphere.

4. An apparatus for supplying molten metal to a casting furnace, the apparatus comprising:

(a) a plurality of chambers;

(b) at least one connection between the chambers that allows for the transfer of molten metal between the chambers;

(c) an outlet from one of the plurality of chambers, said outlet being connected to a casting furnace, arranged to accept an over-flow of molten metal from the chamber such that said over-flow of molten metal can be discharged into the casting furnace, and comprised of a trough and a downspout; and (d) a pump for the transfer of molten metal from an upstream chamber to a downstream chamber.

5. The apparatus of claim 4, wherein said pump is a variable speed centripetal pump.

6. The apparatus of claim 4, further comprising a control arrangement, said control arrangement being functional to vary the rate of speed of said pump to thereby control the over-flow of molten metal to the casting furnace.

7. The apparatus of claim 4, further comprising a sensing system to sense downstream parameters.

8. The apparatus of claim 7, wherein said sensing system comprises an outlet sensor adapted to detect the presence of molten metal in said outlet.

9. The apparatus of claim 8, wherein said outlet sensor is adapted to measure the level of molten metal present in said outlet.

10. The apparatus of claim 4, further comprising a recirculation conduit that allows molten metal to flow from the downstream chamber to the upstream chamber.

11. The apparatus of claim 1, wherein said downspout has a first end and a second end; wherein said trough is connected to the first end of said downspout; and wherein the second end of said downspout is disposed below a surface of molten metal previously discharged into the casting furnace.

12. The apparatus of claim 6, wherein said pump is responsive to a signal initiated by said sensing system.

13. An apparatus for the introduction of molten metal to a casting furnace comprising:

(a) an upstream chamber for holding molten metal;

(b) a downstream chamber for holding molten metal;

(c) a wall substantially separating the upstream chamber from the downstream chamber;

(d) a pump disposed within an opening in the wall, said pump adapted to raise the level of molten metal in the downstream chamber above the level of metal in the upstream chamber; and (e) an outlet trough connected to the downstream chamber.

14. The apparatus of claim 13, wherein said pump is structured to raises the level of molten metal in the downstream chamber to a level wherein the molten metal overflows the downstream chamber.

15. The apparatus of claim 14, wherein said pump operates to over-flow molten metal in the downstream chamber in response to a signal received from a level sensor located in a casting furnace.

16. An apparatus for the introduction of molten metal to a casting furnace comprising:

(a) an upstream chamber for holding molten metal;

(b) a downstream chamber for holding molten metal;

(c) a sensor adapted to measure the level of molten metal in a trough connecting the downstream chamber to the casting furnace, said sensor being capable of generating a prompt representing the level; and (d) a pump adapted to transfer molten metal from the upstream chamber to the downstream chamber, wherein said pump is adapted to be responsive to said prompt.

* * * * *

UNITED STATES PATENT AND TRADEMARK OFFICE

CERTIFICATE OF CORRECTION

PATENT NO. : 6,902,696 B2
DATED : June 7, 2005
INVENTOR(S) : Marshall A. Klingensmith et al.

It is certified that error appears in the above-identified patent and that said Letters Patent is hereby corrected as shown below:

Column 5,
Line 7, “pump” should read -- pumps --.

Column 7,
Line 41, remove the “)” after “310”.

Column 10,
Line 45, “raises” should read -- raise --.

Signed and Sealed this

Twenty-third Day of August, 2005

JON W. DUDAS
*Director of the United States Patent and Trademark Office*